US006517469B1

(12) United States Patent
Mercier

(10) Patent No.: US 6,517,469 B1
(45) Date of Patent: Feb. 11, 2003

(54) EXERCISING DEVICE FOR CONDITIONING THE BODY

(75) Inventor: Pierre Mercier, Laval sure le Lac (CA)

(73) Assignee: Mix Promotion, Inc., Quebec (CA)

( * ) Notice: Subject to any disclaimer, the term of this patent is extended or adjusted under 35 U.S.C. 154(b) by 0 days.

(21) Appl. No.: 09/712,647

(22) Filed: Nov. 14, 2000

(51) Int. Cl.[7] ..... A63B 22/02
(52) U.S. Cl. ..... 482/126; 482/121
(58) Field of Search ..... 482/111, 121, 482/129, 136, 122, 123, 114, 126, 138

(56) References Cited

U.S. PATENT DOCUMENTS

| | | | | |
|---|---|---|---|---|
| 1,019,861 A | | 3/1912 | Titus | |
| 1,680,901 A | | 8/1928 | Meyer | |
| 2,261,173 A | | 11/1941 | Maxwell | 272/83 |
| 2,356,260 A | | 4/1944 | Maxwell | 272/83 |
| 3,920,241 A | | 11/1975 | Belkir | 278/83 R |
| 4,023,796 A | | 5/1977 | Kusmer | |
| 4,334,678 A | | 6/1982 | Doyel | 272/141 |
| 4,465,276 A | | 8/1984 | Cox | |
| 5,022,648 A | | 6/1991 | Travis | |
| 5,458,555 A | | 10/1995 | Ko | 482/126 |
| 5,522,783 A | | 6/1996 | Gordon | 482/127 |
| 5,549,532 A | | 8/1996 | Kropp | 482/126 |
| 5,613,928 A | | 3/1997 | Laudone | 482/139 |
| 5,634,874 A | | 6/1997 | Kest et al. | 482/118 |
| 5,669,862 A | | 9/1997 | Sayman | 482/127 |
| 5,741,207 A | | 4/1998 | Buoni et al. | 482/124 |
| 5,868,651 A | * | 2/1999 | Washington | 482/91 |
| 6,120,421 A | * | 9/2000 | Kuo | 482/111 |
| 6,254,517 B1 | * | 7/2001 | Kennedy | 482/121 |

* cited by examiner

*Primary Examiner*—Jerome W. Donnelly
(74) *Attorney, Agent, or Firm*—Myers Bigel Sibley & Sajovec, PA

(57) ABSTRACT

The exercise device of the present invention is for performing a series of exercises for conditioning the body. The device has an elongated base member, two side arms pivotally connected at one end to the elongated base member, two tensioners each including an adjustable slide and a slide lock, two elastic cords for providing tension to the side arms, a lock located at the free ends of the side arms for locking the side arms together at the free ends, eyelets located at the free ends of the side arms and a pair of handles for attaching to the eyelets on the side arms.

10 Claims, 20 Drawing Sheets

EXERCISING DEVICE FOR CONDITIONING THE BODY

FIELD OF THE INVENTION

The present invention relates to an exercise device for performing a series of exercises for conditioning the body, having a base member, a left side arm and a right side arm and a tensioning means for biasing the left and right side arms into a normally extended position.

BACKGROUND OF THE INVENTION

The need for keeping the human body fit and in good physical condition is well known, and for this reason, fitness and health clubs, with their wide assortments of weight training and other exercise equipment, have become popular places. However, what has not been adequately addressed are means to maintain one's hard earned good physical condition when one is required to frequently travel and can not visit his/her regular health club or gym. Moreover, the vast majority of persons do not even avail themselves of the benefits of regular workouts, whether at health clubs or otherwise. Thus, a tremendous need exists for providing simple, lightweight, compact portable exercise devices that are adaptable for use in training a large variety of human muscle groups.

It is well recognized that the human body requires a sufficient amount of proper exercise for stimulation and improvement of the cardiovascular system necessary for the maintenance of good health. In this regard, numerous exercising devices have been designed to achieve this goal. Some of the well known types of exercising devices employ weights which are lifted in a prescribed manner through a range of motion for exercising a particular set of muscles. Other well known types of exercising devices employ mechanisms, such as springs or rubber bands, to produce elastic resistance to movement in a particular direction. Still other well known types of exercising devices utilize a friction mechanism which generates a resistance proportional to relative movement of various components of the exercising device.

Devices to aid in the exercise of various muscle groups have been manufactured for many years. The use of a bar with an elastic cord to simulate weight lifting was described as early as 1912 in U.S. Pat. No. 1,019,861. More recent attempts employing a bar and/or an elastic cord member, either separately or together, to facilitate exercise are described in U.S. Pat. Nos. 5,458,555 (1995), 5,669,862, and 5,741,207 (1998). Each of these devices provides means for exercising select muscle groups and some are relatively compact. However, none of the prior art devices provide a single, fully reducible, compact exercise device that is adaptable for exercising and training a full complement of human muscle groups. It is toward this that the present invention is directed.

SUMMARY OF THE INVENTION

In accordance with the present invention, an exercising device is provided for conditioning the body, said exercising device having a base member, left side arm and a right side arm and a tensioning means for biasing the left and right side arms into a normally extended position.

Accordingly, it is a primary object of the present invention to provide a compact, portable, lightweight exercising device. As presently preferred, the exercising device is configured to enable a user to perform exercises for working the muscle groups of the upper and lower anatomy. However, the exercising device may also be configured for other ranges of motion to exercise other muscle groups, such as sit-ups and thigh crunches.

It is an object of the present invention to provide an exercising apparatus which is anatomically and ergonomically designed for the exercise to be performed such that it is simple and safe to use by able-bodied individuals and disabled individuals without the assistance of others.

It is another object of the present invention to provide a portable exercising apparatus which is readily adaptable to a wide range of individuals, including children, women and men.

It is still a further object of the present invention to provide an exercise device which uses an adjustable resistance mechanism in which the load is easily adjustable from a low resistance/high repetition aerobic mode to a high load/low repetition muscle building, anearobic mode.

It is another object of the present invention to provide a resistance mechanism which employs an elastic resistance mechanism for providing a quiet, smoothly operating resistance mechanism for creating resistance.

It is an additional object of the present invention to provide an exercising apparatus which may be stowed in a compact arrangement for facilitating storage and transportation of the device.

Further objects, features and advantages of the invention will become apparent from a consideration of the following description and the appended claims when taken in conjunction with the accompanying drawings.

DETAILED DESCRIPTION OF THE PREFERRED EMBODIMENTS

Figure 1:
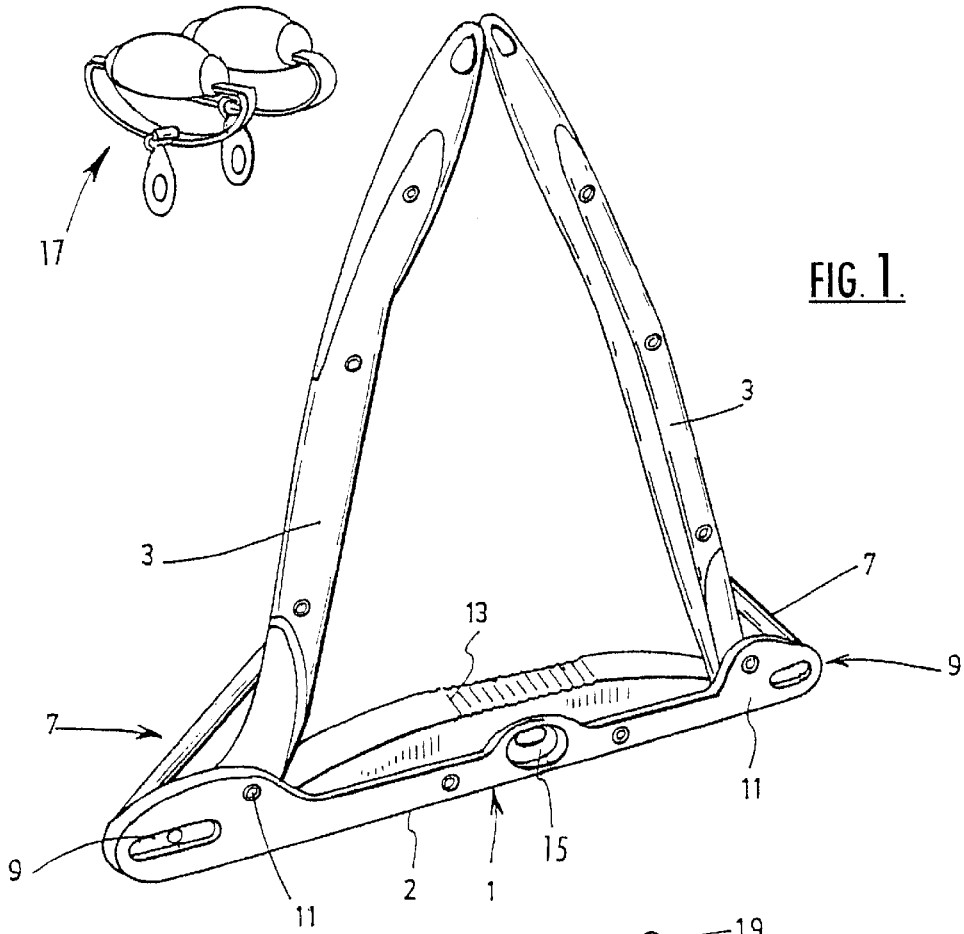
FIG. 1 is a perspective view of the exercising device for conditioning the body in the contracted position.
Figure 2:
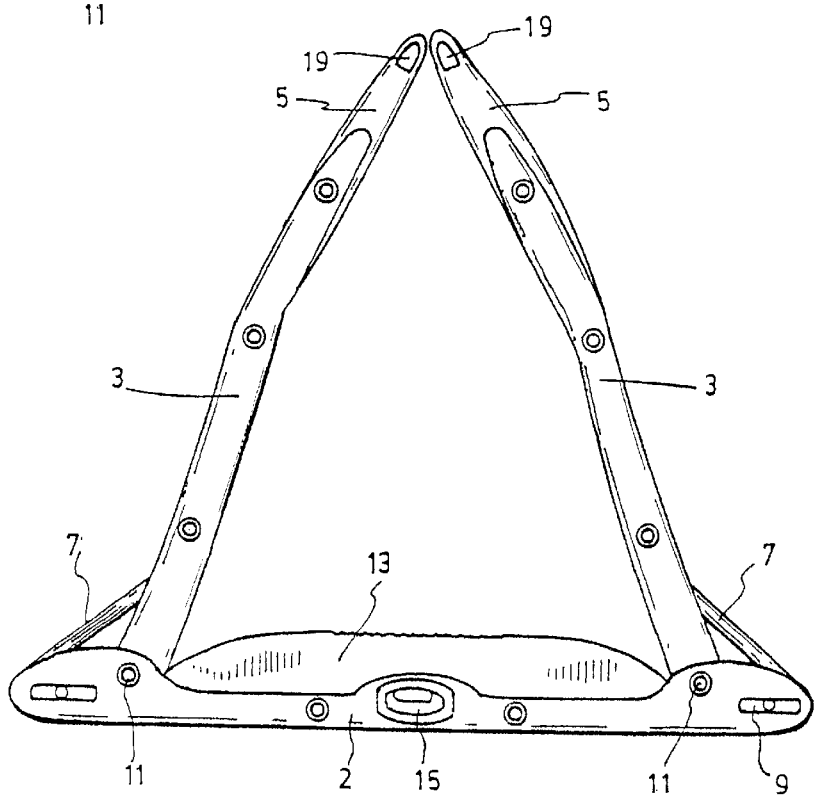
FIG. 2 is a side view of the exercising device in the contracted position.

Referring now to FIG. 1 and FIG. 2, there is shown an exercising device, 1, according to the present invention. In a preferred embodiment, the device has an elongated base member 2, and first and second side arms 3. The side arms 3 are connected by a pivot 11 proximate to the ends of the elongated base member 2. A first and second biasing means each preferably comprised of an elastic cord 7 and an adjustable slide assembly 9 are coupled between said side arms and said elongated base member for biasing said side arms to a normally extended position (shown in FIG. 3). The elastic cord 7 exerts tension on the side arm 3 such that when the side arm is released by the user it will move from the contracted position to the extended position. Conversely, when the side arm is pulled by the user inwardly, it offers resistance.

Figure 11:
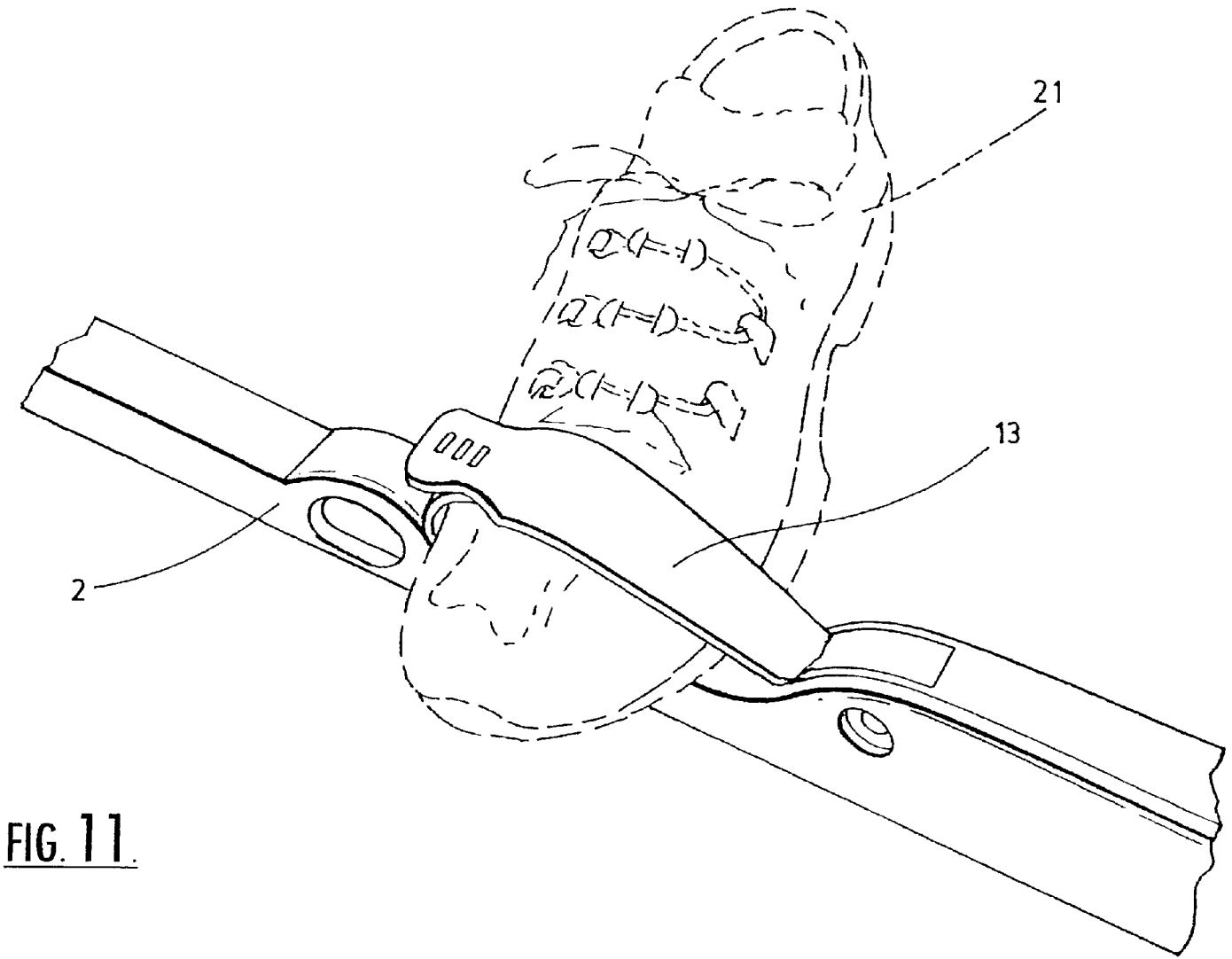
FIG. 11 is a detail elevational view of the exercising device illustrating a foot inserted in the foot strap.
Figure 12:
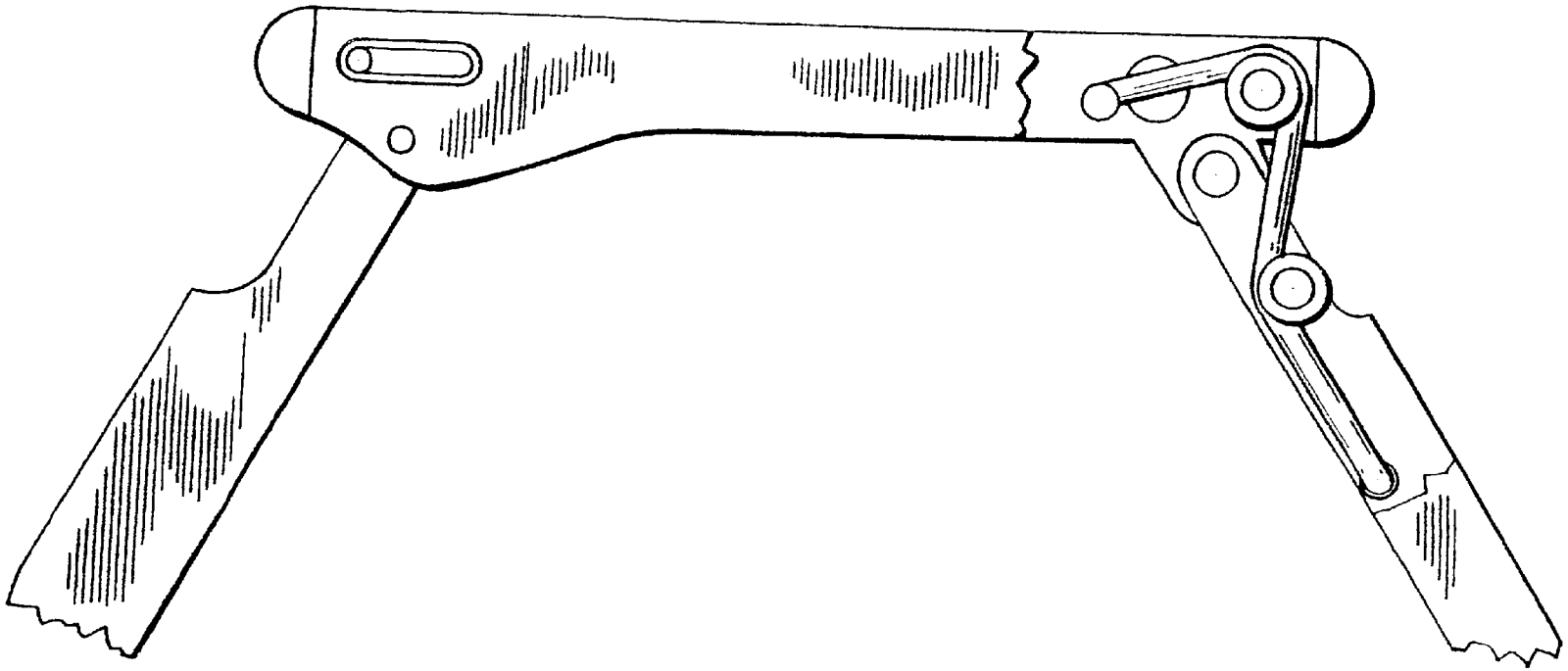
FIG. 12 is a side view of the exercising device illustrating a first alternative adjusting means for varying tension.
Figure 13:
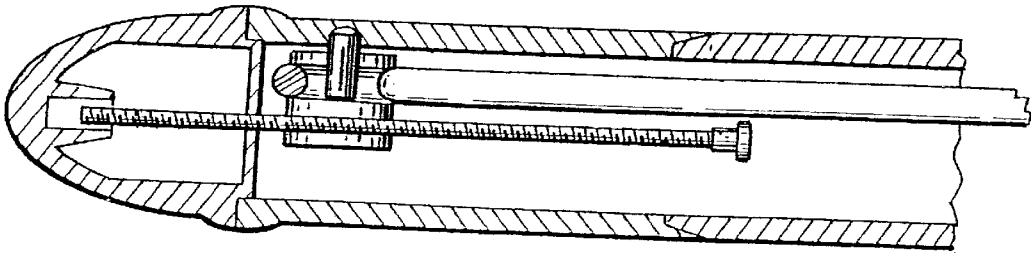
FIG. 13 is a series of view of the exercising device illustrating a second alternative adjusting means for varying tension.
Figure 14:
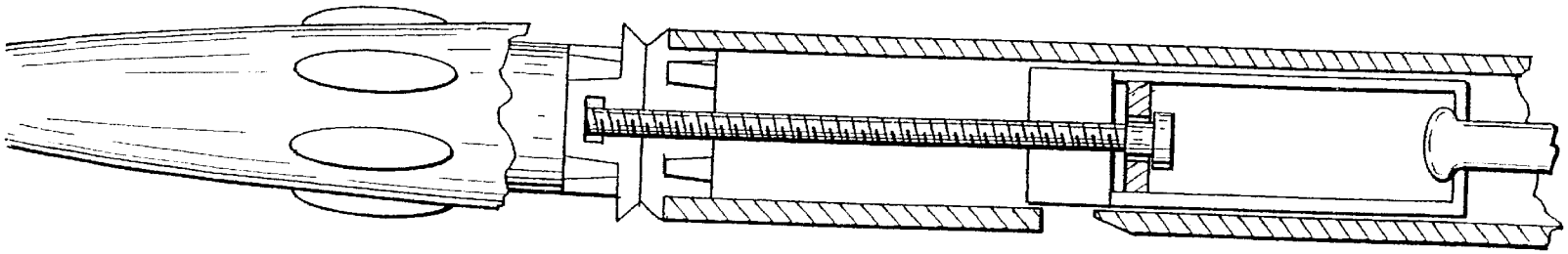
FIG. 14 is a series of view of the exercising device illustrating a third alternative adjusting means for varying tension.
Figure 15:
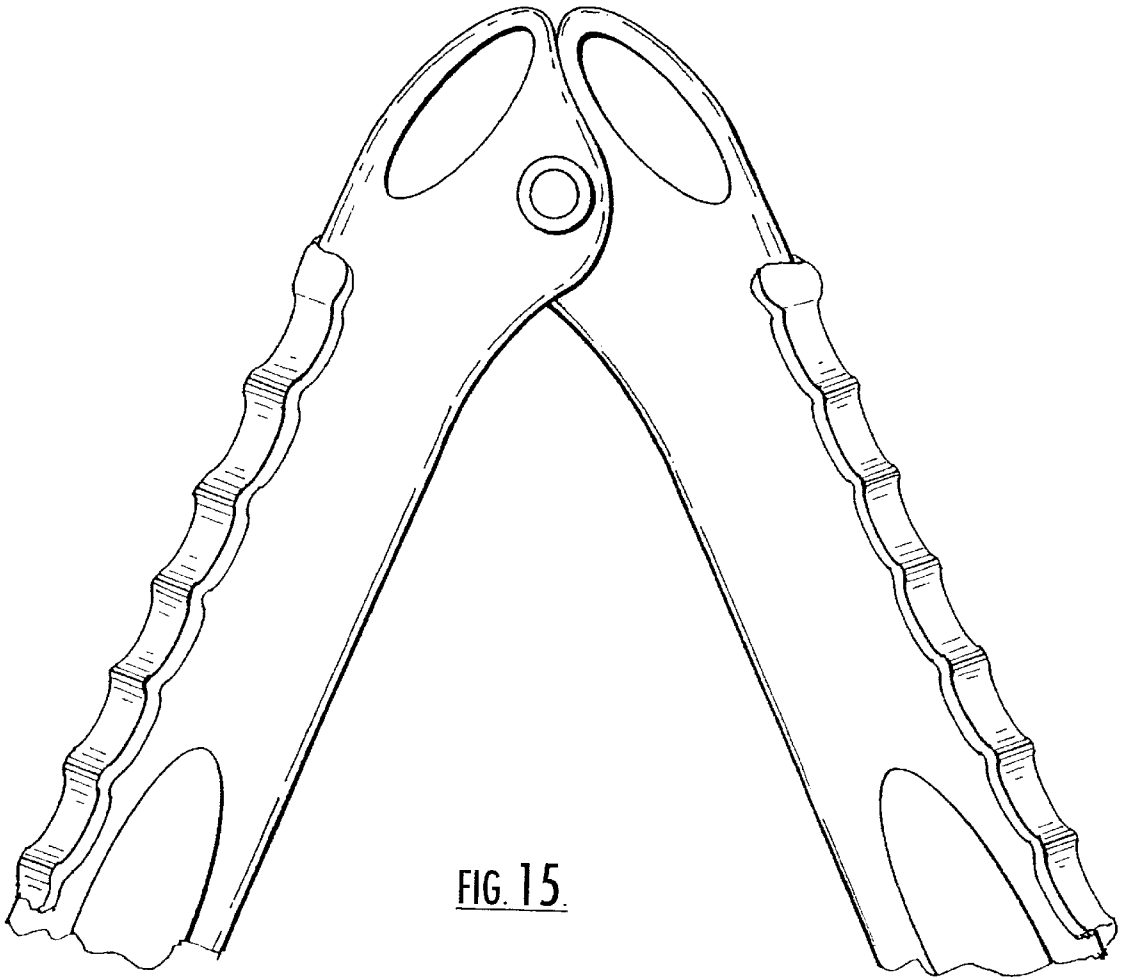
FIG. 15 is a detail side view of the exercising device illustrating a first alternative locking device and eyelets.

A pair of adjustable foot straps 13 are attached to the upper surface of the elongated base member 2 as better shown in FIG. 11, for performing different exercises.

At each of the free ends of the side arms 3, a hand grip 5 is located, fashioned from an appropriate non-slip material. Eyelets 19, are also located at the free ends of the side arms. In another embodiment, a pair of handles 17 can be attached to the eyelets for performing different exercises. The side arms 3 each have a length at least equal to the length of the elongated base member.

Figure 3:
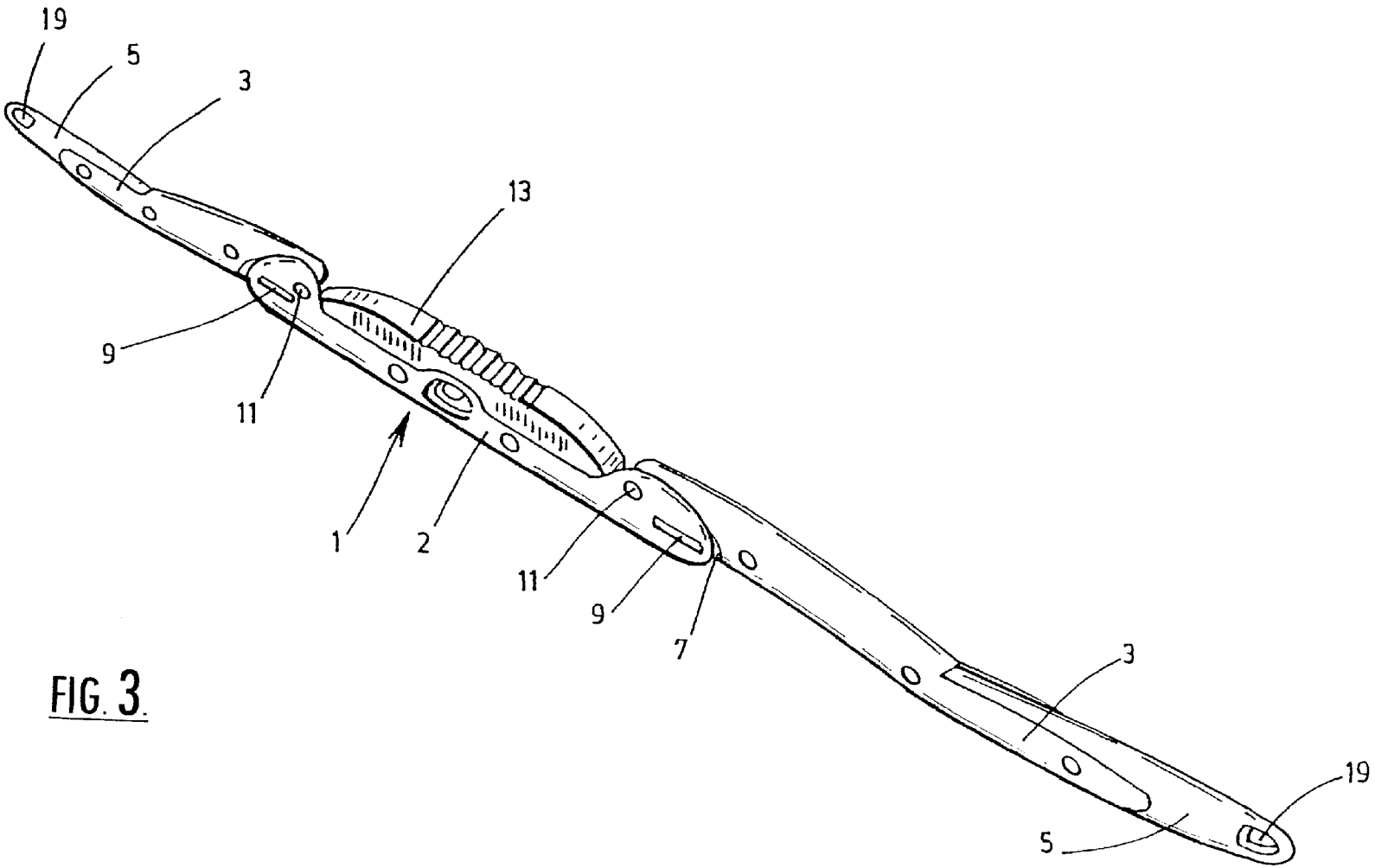
FIG. 3 is an elevational view of the exercising device in the extended position.
Figure 4:
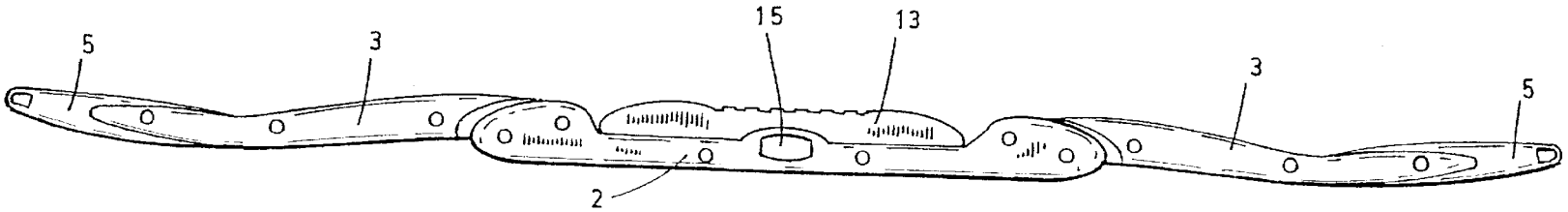
FIG. 4 is a side view of the exercising device in the contracted position.
Figure 5:
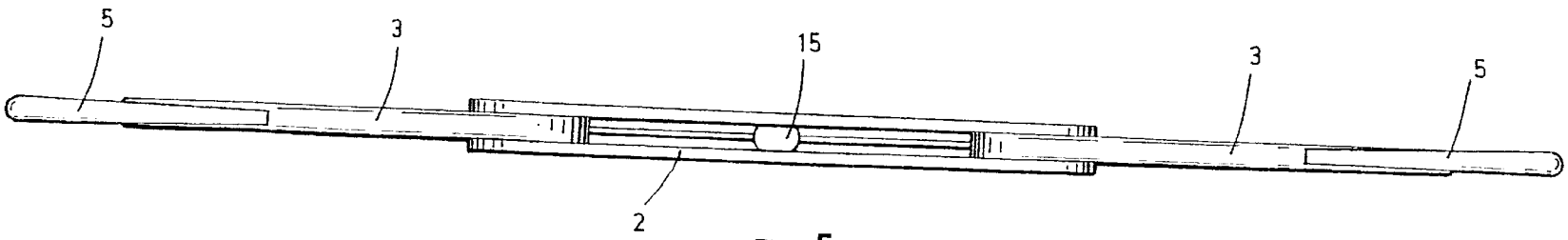
FIG. 5 is a top view of the exercising device in the contracted position.

Referring now to FIG. 3, there is shown the same embodiment of the present invention in the normally extended position. When the side arm 3 is moved from the normally extended position to the contracted position a force is exerted by the elastic cord 7 against the direction of movement. Movement of the adjustable slide away from the middle towards the end of the elongated base member 2 increases the amount of tension which is exerted by the elastic cord on the side arm. Thus, a user can adjust the tension, depending on the type of exercise done.

Figures 6, 7:
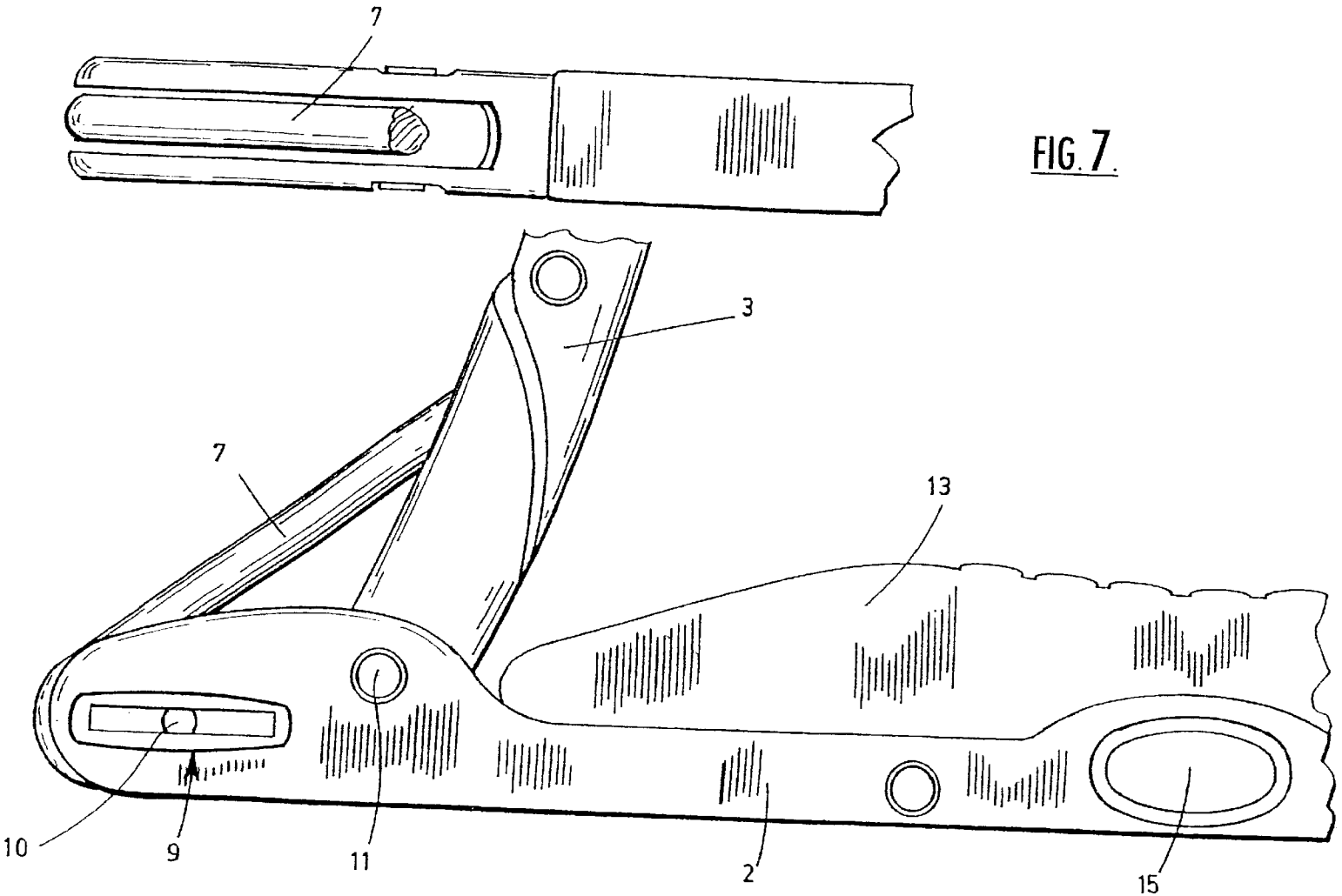
FIG. 6 is a detail side view of the exercising device in the contracted position.
FIG. 7 is a detail top view of the exercising device in the contracted position.

Referring now to FIG. 6, there is shown a side detailed view of the biasing means of the same embodiment of the present invention. An adjustable slide assembly 9 is released by depressing a button 10 and is positionable at one of three positions corresponding to low, medium and high tension, which is then exerted on the side arm 3 by the elastic cord 7. Release of the button 10 locks the slide assembly 9 in one of the three positions. Alternatively, a fine adjustment knob 15 can also be included to increase or decrease tension exerted by the elastic cord on the side arm.

Figure 8:
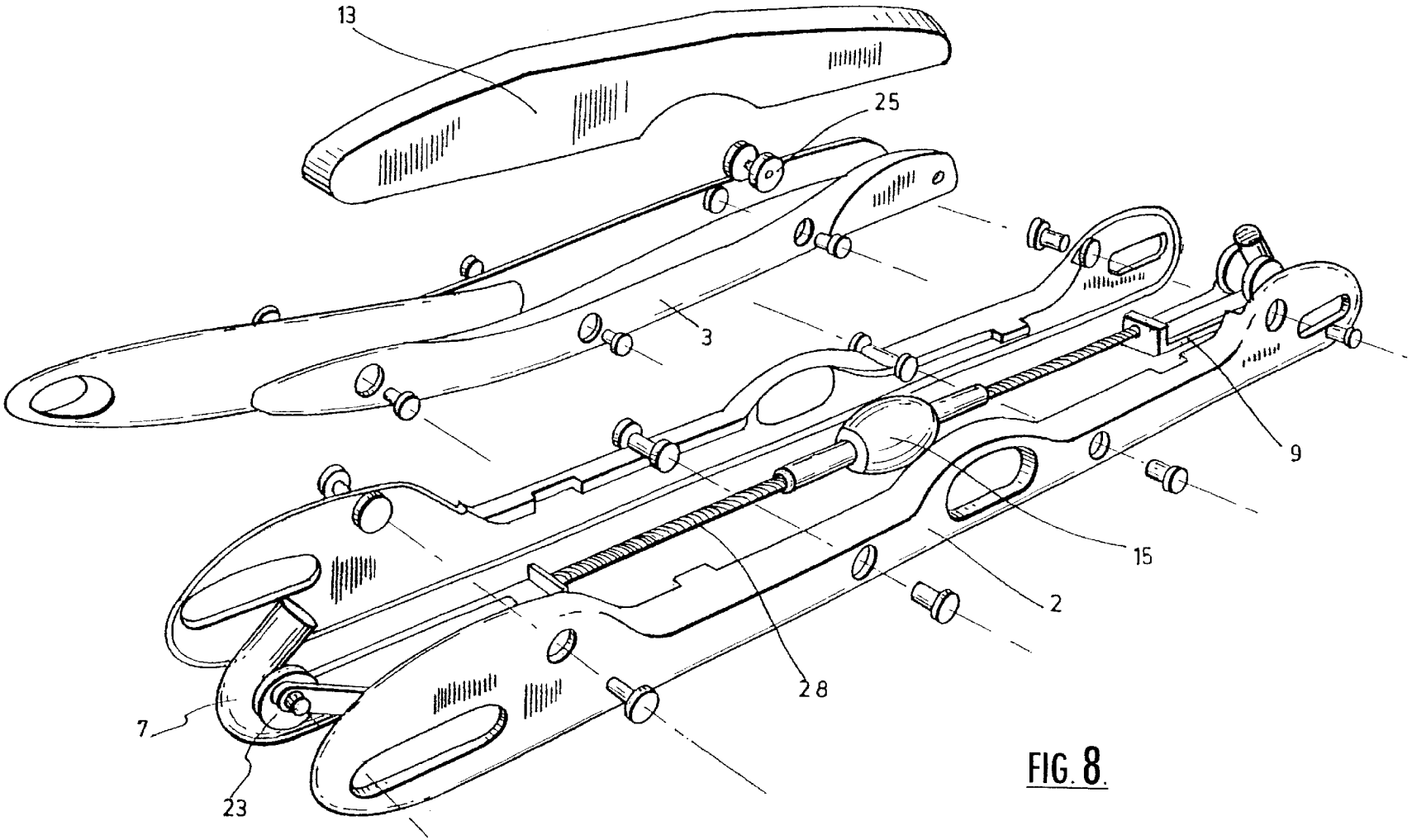
FIG. 8 is an exploded elevational view of the exercising device.

Referring now to FIG. 8, the elastic cord 7 is attached at the first end to a threaded rod 27. The elastic cord passes over a pulley 23 which forms part of the adjustable slide assembly 9. The elastic cord continues over a second pulley 25 and is attached proximate to the free end of the side arm 3. Twisting the adjusting knob 15 causes the threaded rod 27 to move inwardly or outwardly depending on the direction the adjusting knob is moved. Movement of the threaded rod towards the centre of the elongated base member 2 causes an increase on the tension in the elastic cord 7.

Figure 9:
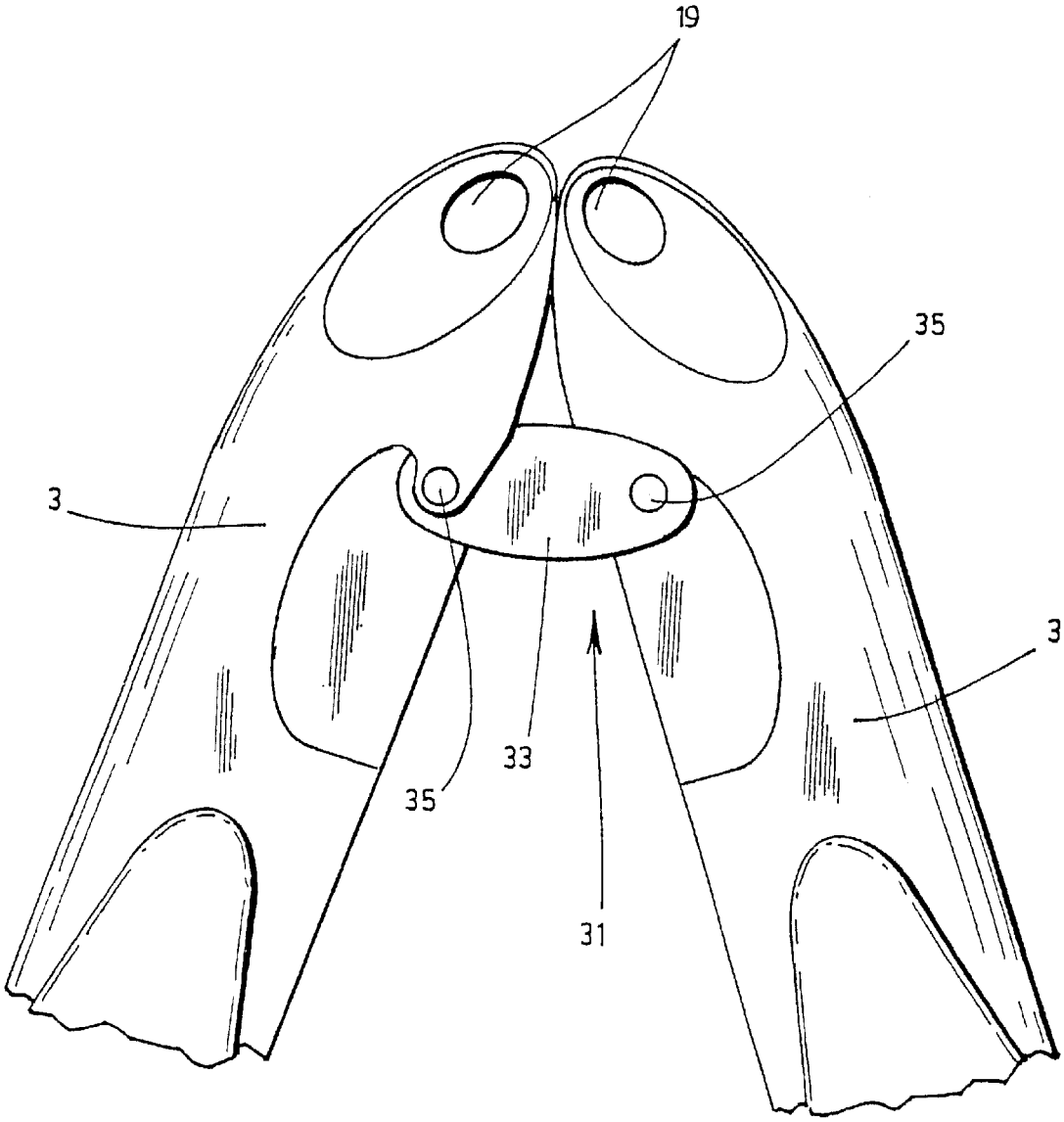
FIG. 9 is a detail side view of the exercising device illustrating a locking device and eyelets.

Referring now to FIG. 9, there is shown a side detail view of the locking means 31 located at the free ends of the side arms 3. The locking means consist of a hook shaped clasp 33 attached proximate to the free end of the side arm 3 by means of a pivot 35. The hooked shaped portion of the clasp fits over a pin located similarly proximate to the free end of the other side arm 3, retaining the side arms in a contracted position. The eyelets 19 located at the free ends of the side arms are also detailed. The locking means are appropriate for storage and transport of the device in a compact and discreet fashion.

Figure 10:
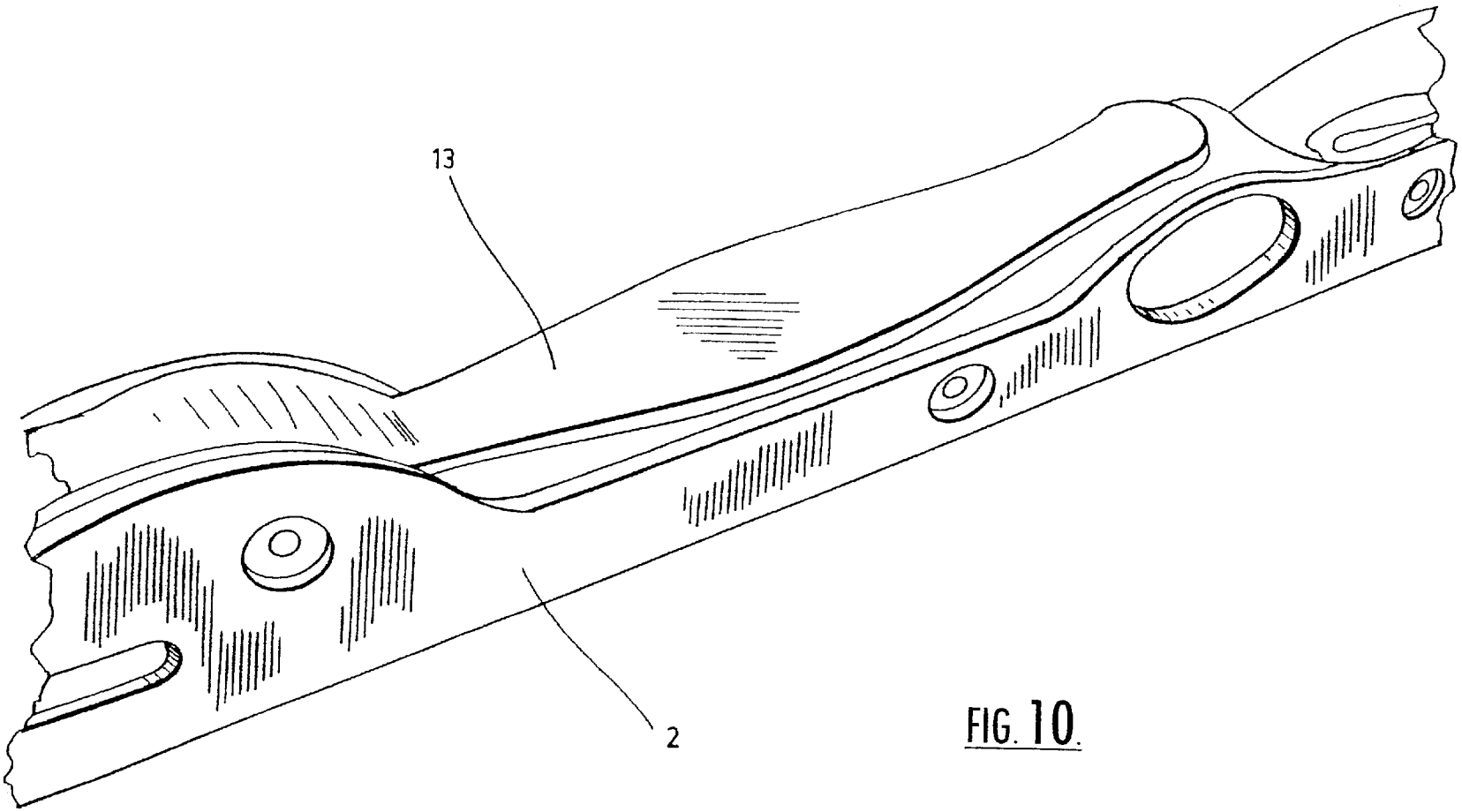
FIG. 10 is a detail elevational view of the exercising device illustrating foot straps.

Referring now to FIG. 10, there is shown an elevational view of the elongated base member 2 attached to the upper surface of which is an adjustable foot strap, 13. Preferably, the adjustable foot strap is covered by a cushion which is held in place by VELCRO™ or the like on which the user may sit or kneel when performing exercises, or which is used for providing comfort when the elongated base member is pressed firmly against the shoulders or back of the neck.

Referring now to FIG. 11 there is shown an elevational view of the elongated base member 2 attached to the upper surface of which is an adjustable foot strap, 13, into which has been inserted a foot 23.

Figure 16A:
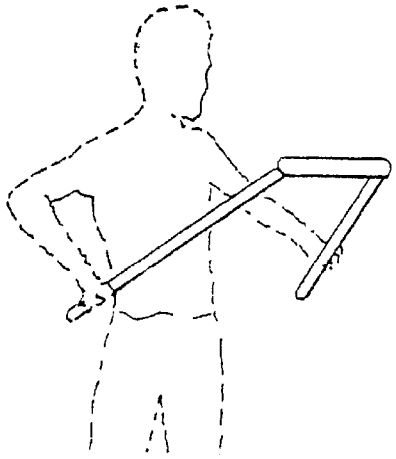
FIGS. 16 to 24 are examples of the different types of exercises that can be performed with the device of the present invention.
Figure 16B:
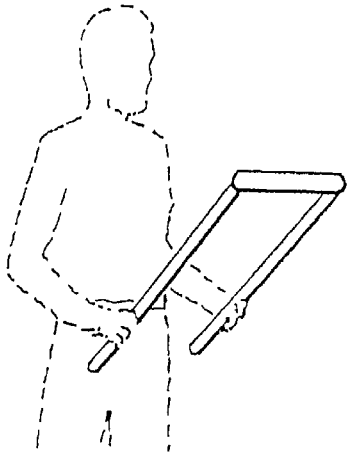
Figure 16C:
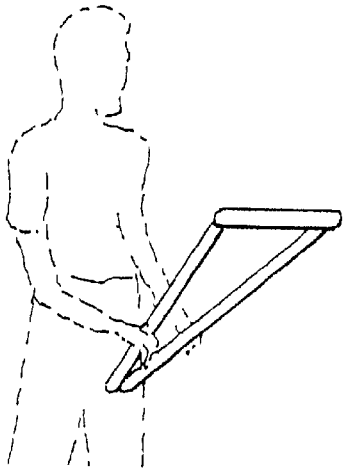
Figure 17A:
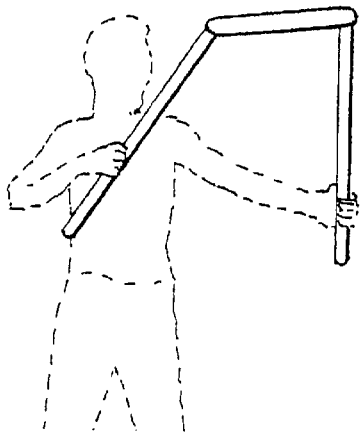
Figure 17B:
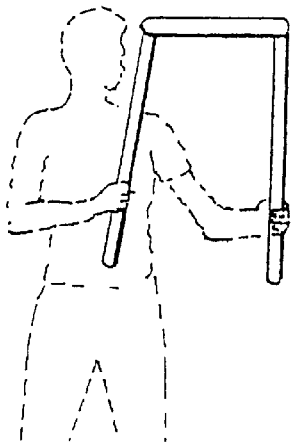
Figure 17C:
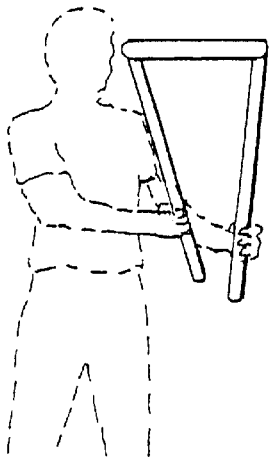
Figure 18A:
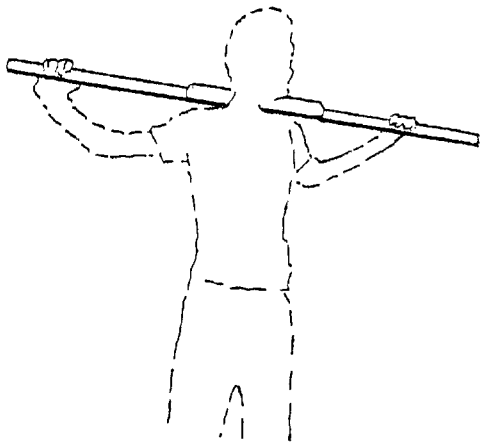
Figure 18B:
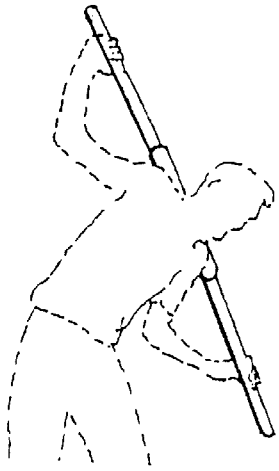
Figure 18C:
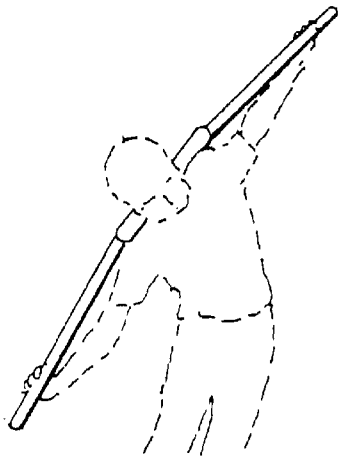
Figure 19A:
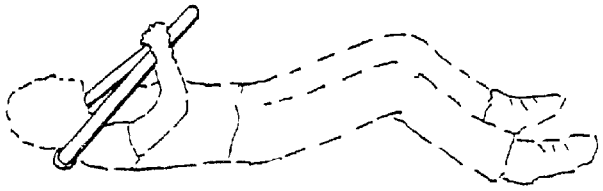
Figure 19B:
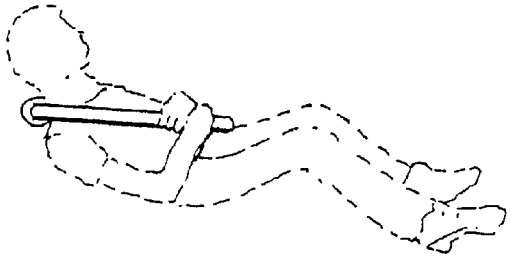
Figure 19C:
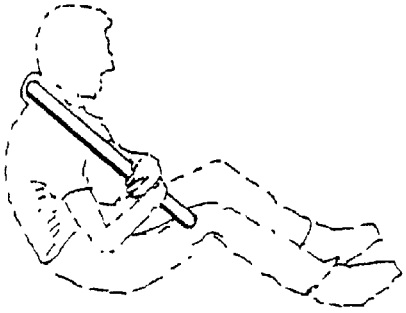
Figure 20A:
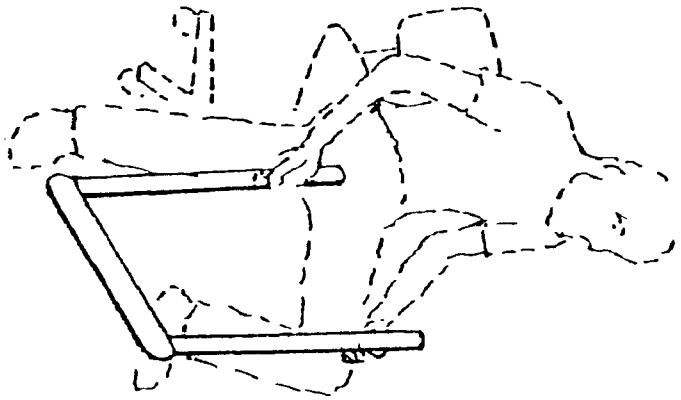
Figure 20B:
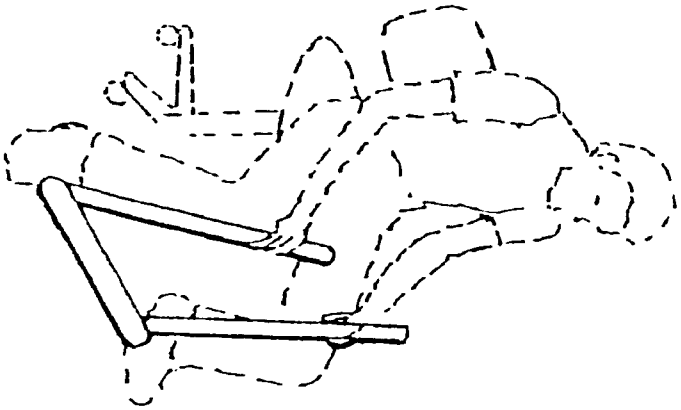
Figure 21A:
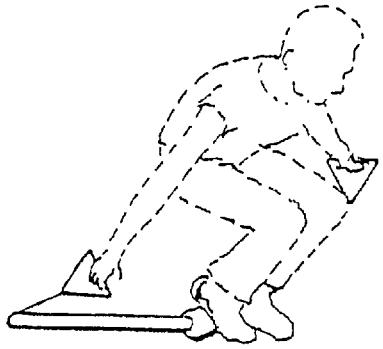
Figure 21B:
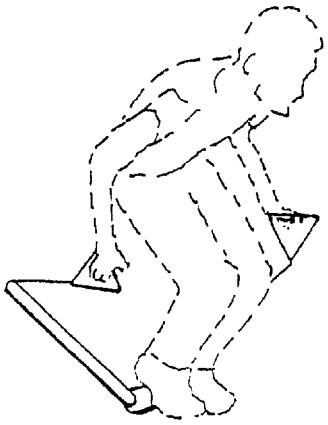
Figure 21C:
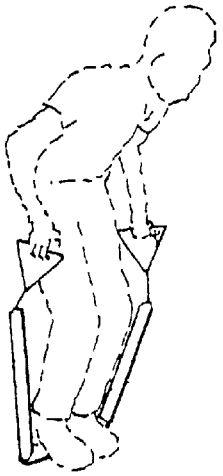
Figure 22A:
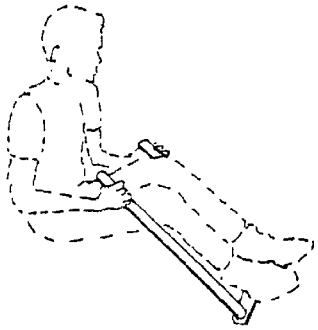
Figure 22B:
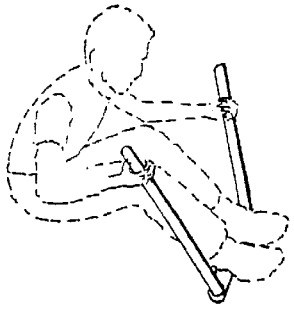
Figure 22C:
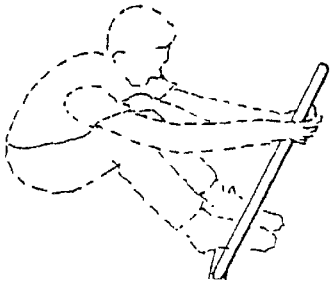
Figure 22D:
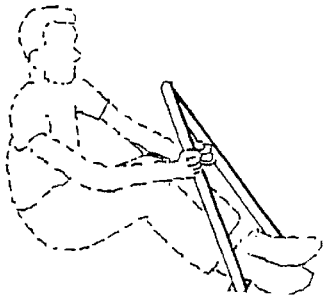
Figure 23A:
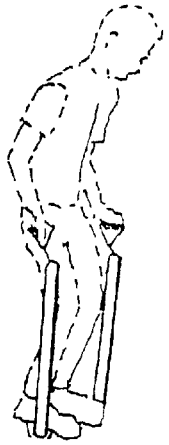
Figure 23B:
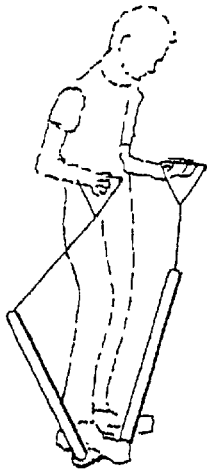
Figure 24A:
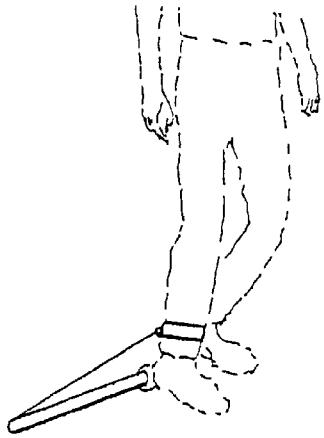
Figure 24B:
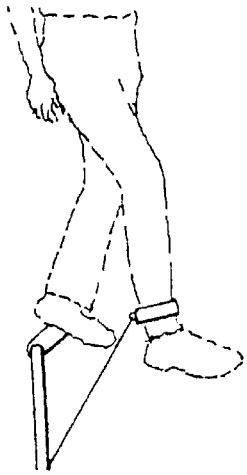
Figure 24C:
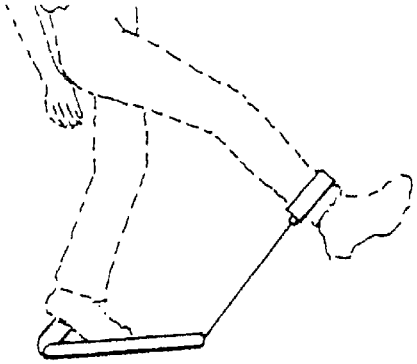

The structure and configuration of the device of a present invention makes particularly suited for performing aerobic and anaerobic exercises. As an example of the types of exercises which can be done with the apparatus of the present invention, reference is now made to FIGS. 16 which exercises the pectorals, biceps and deltoids; FIG. 17 which exercises the triceps, pectorals and forearms; FIG. 18 which shows stretching; FIG. 19 which shows set-ups for the abdominals; FIG. 20 which shows an exercise for the inner thigh; FIG. 21 which shows the type of exercise for cardiovascular exercises as well as FIG. 22; FIG. 23 and FIG. 24 show different exercises as well.

It will be readily apparent to a person skilled in the art that the present device used in combination with the handles can be placed in a variety of different configurations and used for a variety of different exercises left only to the imagination of the health professional devising the same.

One of the advantages of the present invention is that since all of the elements of the device lie in the same plane, it is firstly, very versatile and secondly, very compact when transported.

Although the present invention has been explained hereinabove by way of a preferred embodiment thereof, it should be pointed out that any modifications to this preferred embodiment, within the scope of the appended claims is not deemed to change or alter the nature and scope of the present invention.

What is claimed is:

1. An exercising device comprising:

an enlongated base member having a first end, a second end, and upper surface, a lower surface and a longitudinal axis;

a first side arm pivotally connected proximate to the first end of said elongated base member and positionable around an axis substantially perpendicular to said longitudinal axis between an extended position and a contracted position;

a first biasing means coupled between said first side arm and said elongated base member for biasing said first side arm to a normally extended position;

a second side arm pivotally connected proximate to the second end of said elongated base member and positionable around an axis substantially perpendicular to said longitudinal axis between an extended position and a contracted position;

a second biasing means coupled between said second side arm and said elongated base member for biasing said second side arm to a normally extended position;

said first side arm and said second side arm each having a length at least equal to a length of said elongated base member; and a locking means located at the free ends of the first side arm and the second side arm for locking the first side arm and the second side arm together at the free ends.

2. The exercising device of claim 9 wherein the first biasing means and the second biasing means are respectively adjustable in tension.

3. The exercising device of claim 1 wherein the first biasing means consists of an elastic cord having an adjustable tension and an adjusting means, the elastic cord having a first end and a second end, the first end being attached to the middle of the elongated base member, said elastic cord extending through the adjusting means and second end being attached towards the free end of the left side arm, the adjustable tension of the elastic cord being increased or decreased by the adjusting means.

4. The exercising device of claim 1 wherein the second biasing means consists of an elastic cord having an adjustable tension and an adjusting means, the elastic cord having a first end and a second end, the first end being attached to the middle of the elongated base member, said elastic cord extending through the adjusting means and said second end being attached towards the free end of the right side arm, the adjustable tension of the elastic cord being increased or decreased by the adjusting means.

5. The exercising device of claim 1 wherein the first biasing means includes a locking means for locking the first side arm in a position substantially perpendicular to the elongated base member and normal to the upper surface.

6. The exercising device of claim 1 wherein the second biasing means includes a locking means for locking the second side arm in a position substantially perpendicular to the elongated base member and normal to the upper surface.

7. The exercising device of claim 1 wherein the elongated base member includes a pair of adjustable foot straps attached to the upper surface.

8. The exercising device of claim 1 wherein a pair of handles are attached to the free ends of the left side arm and the right side arm.

9. A portable exercising device comprising:

an elongated base member having a first end, a second end, an upper surface, a lower surface and a longitudinal axis, the upper surface being contoured in a manner which insures comfort to the user when in use, the lower surface being substantially flat;

a first side arm having a fixed end and a free end, said fixed end pivotally connected proximate to the first end of said elongated base member and having a shape and being made of a material which facilitates gripping by a hand proximate to the free end of the first side arm;

a first tensioner located proximate to the first end of the elongated base member, said first tensioner including an adjustable slide and a slide lock, said adjustable slide positionable along the longitudinal axis of the elongated base member whereby the position of the adjustable slide is determined by the slide lock;

a first elastic cord with a first end and a second end, said first end being attached proximate to the middle of the elongated base member, extending through the first tensioner and through the first side arm, the second end being attached proximate to the free end of the first side arm;

a second side arm having a fixed end and a free end, said fixed end pivotally connected proximate to the first end of said elongated base member and having a shape and being made of a material which facilitates gripping by a hand proximate to the free end of the second side arm;

a second tensioner located proximate to the first end of the elongated base member, said second tensioner including an adjustable slide and a slide lock, said adjustable slide positionable along the longitudinal axis of the elongated base member whereby the position of the adjustable slide is determined by the slide lock;

a second elastic cord with a first end and a second end, said first end being attached proximate to the middle of the elongated base member, extending through the second tensioner and through the second side arm, the second end being attached proximate to the free end of the second side arm;

a lock located at the free ends of the first side arm and the second side arm for locking the first side arm and the second side arm together at the free ends;

an eyelet located at the free ends of the first side arm and the second side arm for attaching a pair of handles; and a pair of handles for attaching to the first side arm and the second side arm.

10. The exercising device of claim 1, wherein said device is portable.

* * * * *